US007166191B2

(12) United States Patent
Suzuki et al.

(10) Patent No.: US 7,166,191 B2
(45) Date of Patent: Jan. 23, 2007

(54) CURL STRAIGHTENING METHOD FOR IMAGE RECEIVING PAPER FOR SUBLIMATION DYE TRANSFER AND CURL STRAIGHTENING DEVICE THEREFOR

(75) Inventors: Taro Suzuki, Tokyo-to (JP); Masamitsu Suzuki, Tokyo-to (JP); Tatsuya Kita, Tokyo-to (JP); Katsuyuki Oshima, Tokyo-to (JP)

(73) Assignee: Dai Nippon Printing Co., Ltd., Tokyo-to (JP)

( * ) Notice: Subject to any disclaimer, the term of this patent is extended or adjusted under 35 U.S.C. 154(b) by 320 days.

(21) Appl. No.: 10/674,193

(22) Filed: Sep. 29, 2003

(65) Prior Publication Data

US 2004/0075211 A1 Apr. 22, 2004

(30) Foreign Application Priority Data

Sep. 30, 2002 (JP) ..... 2002-285882

(51) Int. Cl.
*B65H 23/35* (2006.01)
*D21H 25/04* (2006.01)

(52) U.S. Cl. ..... 162/197; 162/270; 271/188; 399/406; 226/196.1

(58) Field of Classification Search ..... 162/118, 162/121, 193, 196, 197, 270, 271, 283, 287; 242/566; 271/188; 399/406; 347/217, 218; 226/196.1; 493/459
See application file for complete search history.

(56) References Cited

U.S. PATENT DOCUMENTS

| | | | | |
|---|---|---|---|---|
| 4,326,915 A | | 4/1982 | Mutschler, Jr. | |
| 5,123,895 A | * | 6/1992 | Mandel | 493/459 |
| 5,300,012 A | * | 4/1994 | Kamada | 493/459 |
| 5,316,539 A | * | 5/1994 | Leemhuis et al. | 493/459 |
| 5,539,511 A | | 7/1996 | Wenthe, Jr. et al. | |
| 5,760,814 A | * | 6/1998 | Kang | 347/218 |
| 5,940,112 A | * | 8/1999 | Siwinski | 347/218 |
| 6,064,853 A | * | 5/2000 | Embry et al. | 399/406 |

FOREIGN PATENT DOCUMENTS

| | | | |
|---|---|---|---|
| EP | 1 391 408 | * | 2/2004 |
| JP | 58-152753 | | 10/1983 |
| JP | 61-081353 | * | 4/1986 |
| JP | 63-32862 | | 3/1988 |
| JP | 02-209357 | * | 8/1990 |
| JP | 03-067847 | * | 3/1991 |
| JP | 04-032453 | * | 2/1992 |
| JP | 4164764 | | 6/1992 |
| JP | 08-133542 | * | 5/1996 |
| JP | 09-171276 | * | 6/1997 |
| JP | 09-188456 | * | 7/1997 |

* cited by examiner

*Primary Examiner*—Eric Hug
(74) *Attorney, Agent, or Firm*—Ladas & Parry LLP

(57) ABSTRACT

To provide a curl straightening method for image receiving paper for sublimation dye transfer, which is capable of realizing a smaller roll core diameter of the roll paper. The curl of an image receiving paper 100 for sublimation dye transfer having stiffness from 500 to 2,500 mg in a direction parallel to the printing direction, which is measured according to JIS L1085, JIS L1096, is straightened by allowing the image receiving paper 100 to pass through gaps 4*a*, 5*a* of a guide 3 that bends the image receiving paper 100 in a reverse curling direction.

12 Claims, 3 Drawing Sheets

CURL STRAIGHTENING METHOD FOR IMAGE RECEIVING PAPER FOR SUBLIMATION DYE TRANSFER AND CURL STRAIGHTENING DEVICE THEREFOR

BACKGROUND OF THE INVENTION

1. Field of the Invention

The present invention relates to a curl straightening method for image receiving paper for sublimation dye transfer printer.

2. Description of the Related Art

In a sublimation dye transfer printer, image receiving paper formed by bonding a conventional paper and a plastic film and having a thickness equal to or more than 200 micrometers is used for realizing quality of feeling like a photograph. The problem with such image receiving paper is that curl remains very often because it is bonded with the film and supplied in a state of a roll.

As a technology to straighten such curl of the roll paper, a technology to press a part of the roll paper and bend it in the reverse direction of the curl, while pulling out the roll paper and applying tensile force thereto, is proposed (for example, see Publication of Japanese Patent Application Laid-Open (JP-A) No. 5-51665, JP-A No. 5-51846, JP-A No. 7-247045, JP-A No. 8-2766, and JP-A No. 8-32748).

However, the curl is difficult to be straightened because the above described image receiving paper essentially has high stiffness so that a wrinkle occurs when the curl is forced to be eliminated.

On this account, when such image receiving paper is formed in a roll form, it is necessary to make the diameter of the roll core as large as possible in a range where the curl is not problematic, and as a result, the diameter of the roll paper becomes large and the problems of downsizing of the printer and handling of the image receiving paper arises.

When the core diameter of the image receiving paper is made smaller in order to deal with the above described problems, the curl of the image receiving paper becomes significantly stronger toward the roll core to bring the curl of the output printed matter strong, and therefore, the problem that the entire image is difficult and skewed to be seen arises. In addition, there is another problem that the image receiving paper is difficult to be mounted when mounted on the board. Further, there is yet another problem that the image receiving paper is difficult to be held by being stacked when massively printed. Furthermore, the problem that, when trying to straighten the curl by rolling it in the reverse direction by hand, the curl can not be straightened more than expected, and a wrinkle occurs on the image surface due to application of strong force arises.

The invention is achieved in light of these problems, and objected to provide a curl straightening method for image receiving paper for sublimation dye transfer, which enables to realize a smaller diameter of the roll core of the roll paper, contribute to downsizing of the rolled image receiving paper and accordingly, to downsizing of the printer, and obtain printed matter with good image quality and handling without residual curl after printing.

SUMMARY OF THE INVENTION

A first curl straightening method of the invention solves the above described problems by straightening curl of image receiving paper for sublimation dye transfer having stiffness from 500 to 2,500 mg in a direction parallel to a printing direction, which is measured according to JIS (Japanese Industrial standards) L1085 or JIS L1096, by allowing the image receiving paper to pass through gaps of a guide that bends the image receiving paper in a reverse curling direction.

According to the first curl straightening method of the invention, the curl is straightened by bending the image receiving paper while allowing the image receiving paper to pass through the guide. Thereby, the curl of the image receiving paper having strong stiffness can be straightened, and the diameter of the image receiving paper can be made smaller to contribute to downsizing of the printer and reduction of the running cost. Note that, in the invention, the direction parallel to the printing direction (direction of printing flow) indicates a direction along which the image receiving paper is pulled out from the roll (feeding direction of the image receiving paper).

The image receiving paper for sublimation dye transfer is formed by bonding a film and paper, and has an advantage that the stiffness and the feel of a material are higher than paper having the same thickness. On the other hand, it has a disadvantage that, when the force for bending the image receiving paper for sublimation dye transfer becomes equal to or more than predetermined strength, the compression stress is easy to be concentrated on a surface layer only, and a buckling wrinkle easily occurs. Therefore, the invention that can straighten the curl without occurrence of the wrinkle is specifically effective for the image receiving paper for sublimation dye transfer.

In the first curl straightening method of the invention, the curl may be straightened so that the curl amount after straightened may take an appropriate value. Note that, in the case where the curl is straightened so that the curl amount may be from −10 to 10 mm, the printed matter can be naturally finished to such an extent that distortion of the image due to the curl can not be visually felt. Further, the handling of the printed matter can be also improved to such an extent that the printed matter can be easily stacked on a stacker in order even in the case where a large amount of image receiving paper is printed. Note that, in the invention, the curl amount indicates the value obtained by measuring and averaging distances from four corners to a stage when the image receiving paper having a length (along a parallel direction to the printing direction) of 89 mm and a width (along an orthogonal direction to the printing direction) of 127 mm is placed on the flat stage with its convex side directed downward. When the image receiving face is directed upward, in the case of curling in the convex direction, the value is expressed as a positive (+) while, in the case of curling in the concave direction, the value is expressed as a negative (−) Note that the length of 89 mm and the width of 127 mm are for specifying the size of the image receiving paper to be used as the reference when the curl amount is measured, and not for limiting the size of the image receiving paper to which the curl straightening method of the invention is applied. In the case where the size of the image receiving paper has a size other than the length of 89 mm and the width of 127 mm, the curl amount can be measured by cutting out the image receiving paper into the length of 89 mm and the width of 127 mm.

Further, a second curl straightening method of the invention solves the above described problems by straightening curl of image receiving paper for sublimation dye transfer by allowing the image receiving paper to pass through gaps of a guide; providing the guide with a first guide unit and a second guide unit that form the gaps by two planes parallel to each other; and providing the second guide unit on an upstream side of the first guide unit in a feeding direction of the image receiving paper; disposing the first guide unit and the second guide unit so that change in the feeding direction of the image receiving paper from the second guide unit to the first guide unit may be opposite to a direction of curling of the image receiving paper; and allowing the image receiving paper to pass through the guide to straighten the curl of the image receiving paper.

According to the second curl straightening method of the invention, the curl of the image receiving paper is straightened by allowing the image receiving paper to pass through the gaps formed by two planes parallel to each other. Thereby, the curl of the image receiving paper having strong stiffness can be straightened, and the diameter of the image receiving paper can be made smaller to contribute to downsizing of the printer and reduction of the running cost.

In the first curl straightening method of the invention, a first guide unit and a second guide unit that form the gaps by two planes parallel to each other may be provided in the guide, the second guide unit may be provided on an upstream side of the first guide unit in a feeding direction of the image receiving paper, and the first guide unit and the second guide unit may be disposed so that change in the feeding direction of the image receiving paper from the second guide unit to the first guide unit may be opposite to a direction of curling of the image receiving paper. The length of the first guide unit may be from 10 mm to 100 mm, and preferably, from 10 mm to 92 mm. If the first guide unit is too short, the straightening strength is too small to sufficiently straighten the curl. On the contrary, if the first guide unit is too long, the straightening strength is so large that a wrinkle is caused. When the length of the first guide unit is within the above described range, the curl of the image receiving paper can be suitably straightened. Note that the length of the guide unit is a length that effectively functions for straightening the image receiving paper.

In the first curl straightening method of the invention, the gap of the first guide unit may be from 1 mm to 7 mm, and more preferably, from 2 mm to 5 mm. If the gap of the first guide unit is too small, the straightening strength is so large that a wrinkle is caused, and also a jam is caused in the guide. On the contrary, if the gap of the first guide unit is too large, the straightening strength is too small to sufficiently straighten the curl. When the gap of the first guide unit is within the above described range, the curl of the image receiving paper can be suitably straightened.

In the first curl straightening method of the invention, the gap of the second guide unit may be from 0.3 mm to 7 mm, and more preferably, from 0.5 mm to 5 mm. If the gap of the second guide unit is too small, the straightening strength is so large that a wrinkle is caused, and also a jam is caused in the guide. On the contrary, if the gap of the second guide unit is too large, the straightening strength is too small to sufficiently straighten the curl. When the gap of the second guide unit is within the above described range, the curl of the image receiving paper can be suitably straightened.

In the first curl straightening method of the invention, an angle formed by the first guide unit and the second guide unit may be from 45 degrees to 145 degrees, and more preferably, from 55 degrees to 135 degrees. If this angle is too small, the straightening strength is so large that a wrinkle is caused, and also a jam is caused in the guide. On the contrary, if the angle is too large, the straightening strength is too small to sufficiently straighten the curl. When the angle is within the above described range, the curl of the image receiving paper can be suitably straightened.

In the first curl straightening method of the invention, the length of the second guide unit may be equal to or more than 5 mm, and more preferably, from 5 mm to 100 mm. If the second guide unit is too short, the straightening strength is too small to sufficiently straighten the curl. Further, the image receiving paper becomes so difficult to be guided to the first guide unit that a jam is caused. When the length of the second guide is within the above described range, the curl of the image receiving paper can be suitably straightened.

A curl straightening device of the invention solves the above described problems by that the device straightens curl of image receiving paper for sublimation dye transfer by allowing the image receiving paper to pass through gaps of a guide, a first guide unit and a second guide unit that form the gaps by two planes parallel to each other are provided in the guide, the second guide unit is provided on an upstream side of the first guide unit in a feeding direction of the image receiving paper, and the first guide unit and the second guide unit are disposed so that change in the feeding direction of the image receiving paper from the second guide unit to the first guide unit may be opposite to a direction of curling of the image receiving paper.

By feeding the image receiving paper into the curl straightening device of the invention, the above described curl straightening methods can be realized.

A third curl straightening method of the invention solves the above described problems by straightening curl of image receiving paper for sublimation dye transfer having stiffness from 500 to 2,500 mg in a direction parallel to a printing direction, which is measured according to JIS L1085 or JIS L1096, so that a curl amount of the image receiving paper, which is measured with respect to a size of the image receiving paper having a length of 89 mm and a width of 127 mm along the direction parallel to the printing direction, may be from −10 to 10 mm, by allowing the image receiving paper to pass through while bending the image receiving paper in a reverse curling direction.

In the third curl straightening method of the invention, the curl may be straightened so that the curl amount may be from −10 mm to 10 mm, and as described above, the printed matter can be naturally finished to such an extent that distortion of the image due to the curl can not be visually felt. Further, the handling of the printed matter can be also improved.

In the third curl straightening method of the invention, the image receiving paper may be allowed to pass through the gaps of the guide that bends the image receiving paper in the reverse curling direction as well as in the first curl straightening method, and further, various preferable embodiments of the first curl straightening method may be included In this case, the curl of the image receiving paper that has strong stiffness becomes easy to be straightened in a range from −10 mm to 10 mm.

In the first to third curl straightening methods, straightening can be performed either before or after printing. Note that, in the case where the curl is straightened after printing, the printer can be more simplified than that in the case where the curl is straightened before printing. In the case where the curl is straightened before printing, the printing matter becomes in a uniform curling state if the printing is continuously performed. However, in the case where the image receiving paper during curl straightening stays in the curl straightening device because the printer becomes in an inactive condition, or the like., if the next printing is started from the state, the curling condition of the printed matter becomes different between in the part that stays during the curl straightening and in the other part. In order to prevent this, it is necessary to provide a mechanism for turning away the curl straightening device when the printing is stopped, or provide a control mechanism for taking up the image receiving paper to the point before entering the curl straightening device. On the other hand, straightening after printing does not need a mechanism as described above, and the printer can be downsized and the running cost can be reduced.

DETAILED DESCRIPTION OF THE PREFERRED EMBODIMENT

Figure 1A:
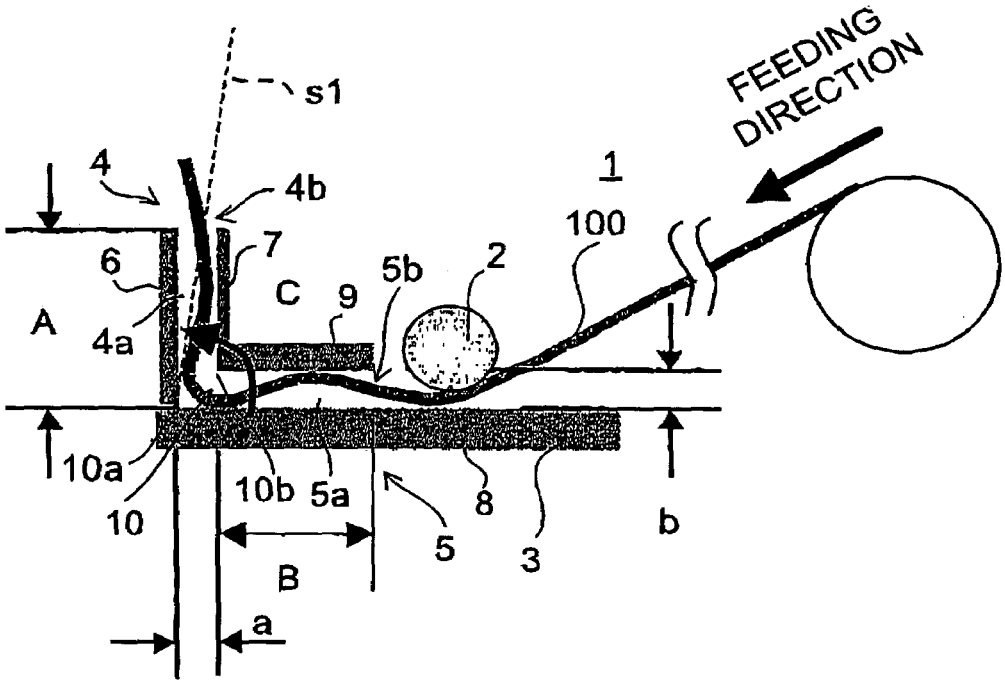
FIGS. 1A and 1B are sectional views of a curl straightening device to which a curl straightening method of the invention is applied.

FIG. 1A is a sectional view of a curl straightening device 1 to which a curl straightening method of the invention is applied. The straightening device 1 includes a feed roller 2 capable of feeding image receiving paper 100 for sublimation dye transfer after printing and a guide 3 for guiding the image receiving paper 100 fed from the feed roller 2.

The guide 3 has a first guide unit 4 and a second guide unit 5. The first guide unit 4 is formed by opposing plates 6 and 7 that are wider than the image receiving paper 100 in parallel to each other, and the second guide unit 5 is formed by opposing plates 8 and 9 that are wider than the image receiving paper 100 in parallel to each other. Therefore, linear paths 4*a* and 5*a* having gaps of a and b between the plates are formed inside of the first guide unit 4 and the second guide unit 5, respectively. The paths 4*a* and 5*a* are connected so as to form a corner 10 at an angle C. The length of the first guide unit 4 is defined by a length A from an outside corner 10*a* of the corner 10 to an exit 4*b* of the path 4*a*. The length of the second guide unit 5 is defined by a length B from an inside corner 10*b* of the corner 10 to an entrance 5*b* of the path 5*a*. By the way, the path 5*a* may not horizontally extend, Further, the angle C may not be a right angle, and it may be smaller than the right angle as shown by a dotted line s1 or may be larger than the right angle.

The image receiving paper 100 is fed into the entrance 5*b* with the face that curls in a convex form directed upward by feed roller 2. Then, the image receiving paper 100 is bent in the reverse direction to the curling direction at the corner 10. Thereby, the curl of the image receiving paper 100 is straightened. Subsequently, the image receiving paper 100 is discharged from the exit 5*b*. By setting the parameters A, a, b, and B to appropriate values, the curl of the image receiving paper 100 can be straightened without occurrence of a wrinkle in the image receiving paper 100.

Figure 1B:
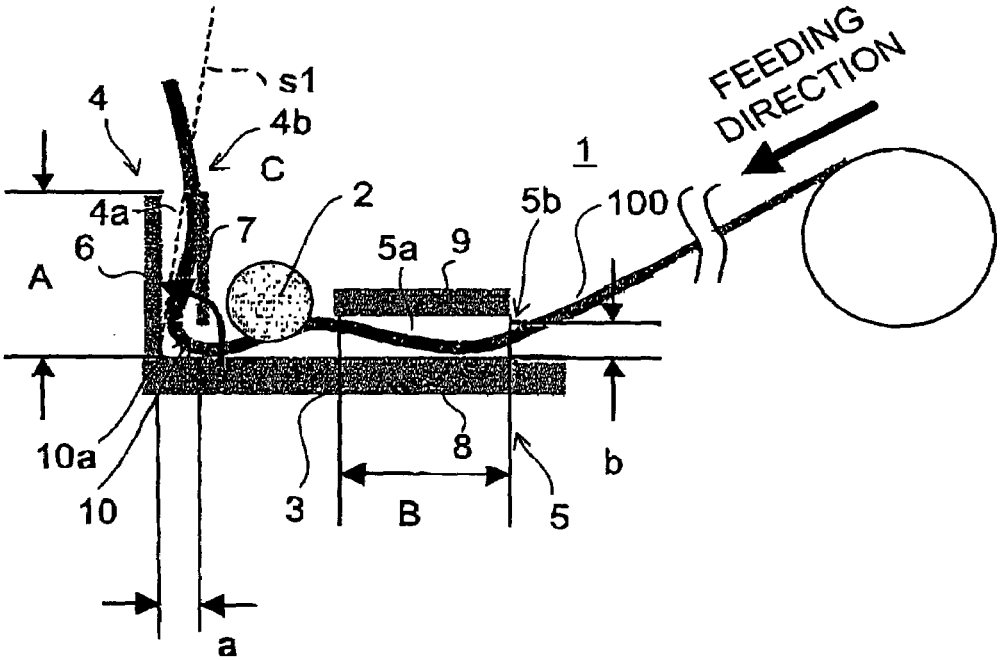

By the way, as shown in FIG. 1B, the feed roller 2 may be provided between the first guide unit 4 and the second guide unit 5. In this case, the parameters A, a, and b are similarly defined, but the parameter B is defined by the length of the plate 9.

In the curl straightening method of the invention, the curl is straightened with image receiving paper having stiffness of 500 to 2,500 mg, which is measured by JIS L1085 or L1096, as a subject. The stiffness may be measured according to JIS L1085 or L1096, and, for example, a Gurley type stiffness tester manufactured by Toyo Seiki Seisaku-sho, Inc. can be used.

Figure 2:
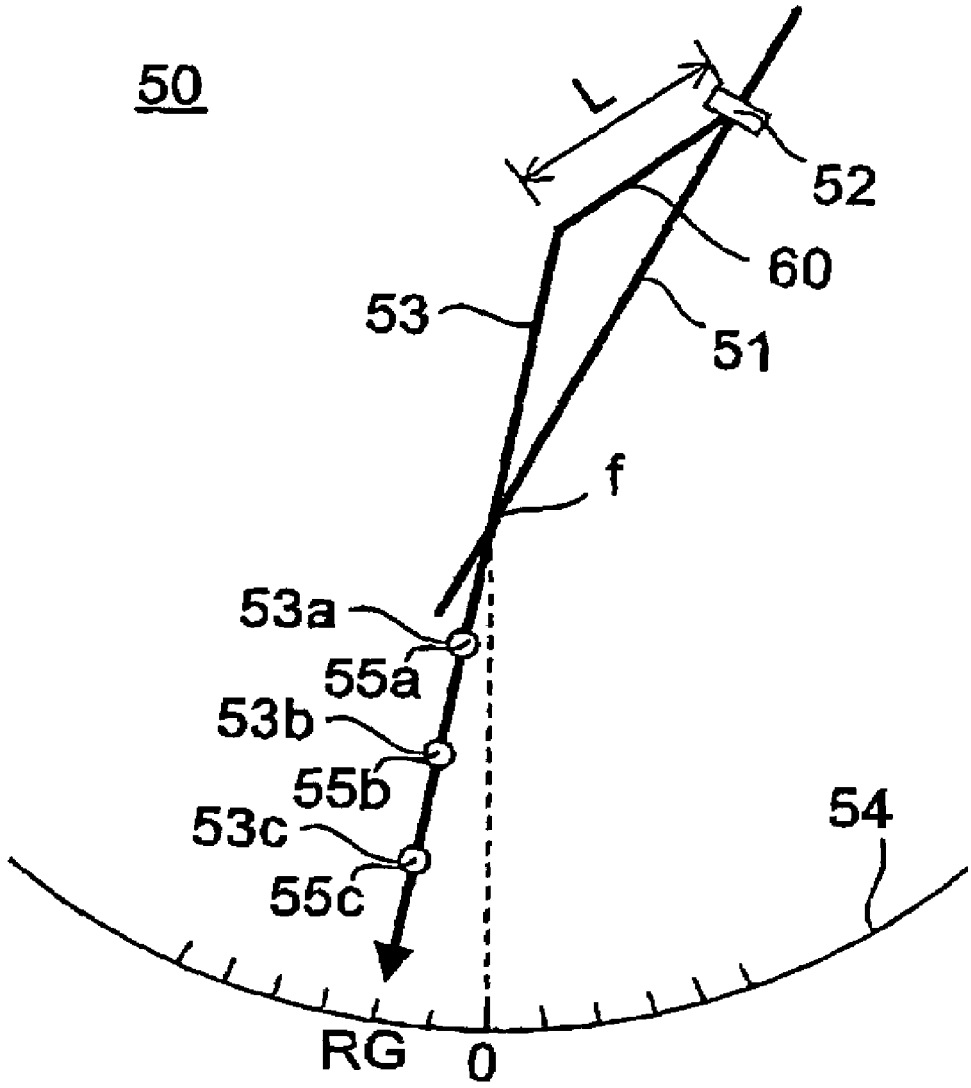
FIG. 2 is a view showing an outline of a Gurley type stiffness tester.

Referring to FIG. 2, the Gurley type stiffness tester will be described in brief. As shown in FIG. 2, the Gurley type stiffness tester 50 includes a movable arm 51, a chuck 52 attached to the movable arm 51, a pendulum 53, and a scale plate 54.

First, five of test pieces 60 in a length of L mm and a width of d mm are taken along longitudinal and lateral directions, respectively. The taken test piece 60 is attached to the chuck 52, and the chuck 52 is fixed in accordance with a predetermined position (L/25.4) of the scale on the movable arm 51. Then, appropriate weights 55*a*, 55*b*, and 55*c* are mounted to weight mounting holes 53*a*, 53*b*, and 53*c* on the lower side of the fulcrum f of the pendulum 53, and the movable arm is rotated at constant speed. The scale RG on the scale plate 54 at the time when the test piece 60 departs from the pendulum 53 is read. The stiffness (softness) is calculated by the following equation, respective longitudinal and lateral average values are obtained, and the values are rounded off to the first decimal place.

$$Br = RG \times (SaWa + SbWb + ScWc) \times \frac{(L-12.7)^2}{d} \times 3.375 \times 10^{-5}$$

$$^{*}Br = RG \times (SaWa + SbWb + ScWc) \times \frac{(L-12.7)^2}{d} \times 3.444 \times 10^{-5}$$

*Br*: stiffness (mN)

$^{*}Br$: stiffness (mgf)

*RG*: scale when the test piese departs from the pendulum (mgf)

*Sa*, *Sb*, *Sc*: distance from the fulcrum to the weight mounting holes 53a, 53b and 53c (mm)

*Wa*, *Wb*, *Wc*: mass of the weights 55a, 55b and 55c (g)

*L*: length of the test piece (mm)

*d*: width of the test piece (mm)

EXAMPLES

Figure 3:
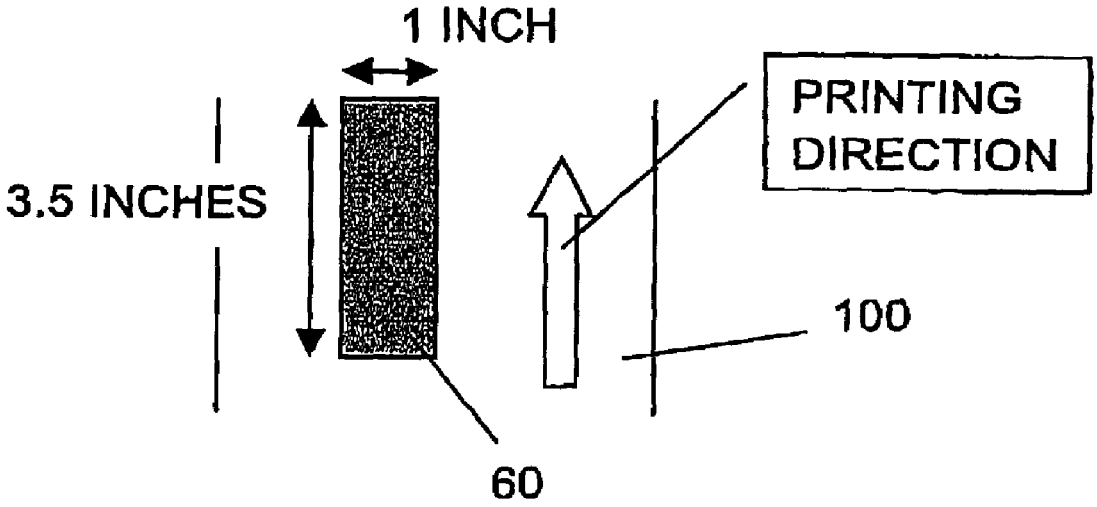
FIG. 3 is a view showing a test piece used for measuring stiffness by the Gurley type stiffness tester in FIG. 2.

The curl of the image receiving paper printed by using a sublimation dye transfer printer S-2045 manufactured by Shinko Electric, Inc. is straightened. Note that, in the printer, the curl amount when the curl is not straightened is as shown in Table 1. This table shows the curl amount in the case of the image receiving paper having stiffness of 1,500 mg. As described above, the curl amount is measured with respect to the size of the image receiving paper in a length of 89 m and a width of 127 mm. The stiffness of the image receiving paper is measured using a piece cut out in parallel to a direction of printing flow into a length of 3.5 inches and a width of 1 inch as a test piece 60 as shown in FIG. 3.

TABLE 1

| roll core diameter (mm) | curl amount before (mm) |
|---|---|
| 30 | 27 |
| 50 | 18 |
| 65 | 17 |
| 90 | 14 |
| 100 | 13 |

The image receiving paper is made by bonding paper with a plastic film. Using paper having thickness of 60, 120, 160, 200, and 260 micrometers as core materials, image receiving paper having stiffness of 65, 500, 1,500, 2,500, and 3,000 mg are formed, respectively. The used image receiving paper is roll paper rolled with image receiving face directed outward.

The evaluation of the curl straightening is performed by evaluating the curl amount, wrinkle, and jam (clogging with paper) of the image receiving paper, respectively.

The curl amount is evaluated as ○ in a range of −10 to 10 mm, Δin a range of −12 to 12 mm, and × in a range equal to or less than −12 mm or equal to or more than 12 mm. Generally, the curl amount that indicates slight convexity (+) on an upper side of the image receiving face is evaluated as good, however, in this case, the curl amount from −10 to 10 mm, which is practically unproblematic, is evaluated as good.

Further, the curl amount is evaluated in the case of the roll core diameter equal to or more than 50 mm, and in the case of the roll core diameter equal to or more than 30 mm, respectively. The cases of the roll diameters equal to or more than 50 mm and equal to or more than 30 mm are evaluated as subjects because one of the objects of the invention is to reduce the roll core diameter of the image receiving paper and relatively smaller roll core diameter is covered as a subject of the evaluation.

The wrinkle is evaluated as × in the case where a sharp wrinkle occurs when straightening the curl, Δ in the case where a slight float is seen as a previous step of a wrinkle, and ○ in the case where there is no float.

The jam is evaluated as × in the case where the number of sheets in which the jam occurs is equal to or more than five out of ten sheets that are continuously printed, Δ in a range equal to or more than one and less than five, ○ in the case of zero.

Table 2 shows examples and comparative examples in the case where the stiffness of the image receiving paper is fixed to 1,500 mg, the parameter B is fixed to 10 mm, and the parameters A, a, b and Care varied. Note that, in this table, the evaluation of the curl amount is expressed by "___" in the case where the curl amount can not be measured because the image receiving paper is bent due to a jam.

TABLE 2

| | stiffness | A | a | b | C | B | curl amount | | wrinkle | jam |
|---|---|---|---|---|---|---|---|---|---|---|
| | (mg) | (mm) | (mm) | (mm) | (degree) | (mm) | 30 mm | 50 mm | | |
| Comp. Ex. 1 | 1500 | 100 | 5 | 0.5 | 55 | 10 | ○ | ○ | X | Δ |
| Comp. Ex. 2 | 1500 | 100 | 5 | 0.5 | 90 | 10 | Δ | ○ | X | Δ |
| Ex. 1 | 1500 | 100 | 5 | 0.5 | 135 | 10 | X | Δ | ○ | Δ |
| Comp. Ex. 3 | 1500 | 100 | 2 | 5 | 55 | 10 | ○ | ○ | X | ○ |
| Comp. Ex. 4 | 1500 | 100 | 2 | 5 | 90 | 10 | ○ | ○ | X | ○ |
| Ex. 2 | 1500 | 100 | 2 | 5 | 135 | 10 | X | Δ | ○ | ○ |
| Comp. Ex. 5 | 1500 | 100 | 2 | 0.5 | 55 | 10 | ○ | ○ | X | Δ |
| Comp. Ex. 6 | 1500 | 100 | 2 | 0.5 | 90 | 10 | ○ | ○ | X | Δ |
| Ex. 3 | 1500 | 100 | 2 | 0.5 | 135 | 10 | X | Δ | Δ | Δ |
| Ex. 4 | 1500 | 92 | 7 | 0.5 | 55 | 10 | Δ | ○ | ○ | Δ |
| Ex. 5 | 1500 | 92 | 7 | 0.5 | 90 | 10 | X | ○ | ○ | Δ |
| Comp. Ex. 7 | 1500 | 92 | 7 | 0.5 | 135 | 10 | X | X | ○ | Δ |
| Ex. 6 | 1500 | 92 | 5 | 0.5 | 55 | 10 | ○ | ○ | ○ | Δ |
| Ex. 7 | 1500 | 92 | 5 | 0.5 | 90 | 10 | Δ | ○ | ○ | Δ |
| Ex. 8 | 1500 | 92 | 5 | 0.5 | 135 | 10 | X | Δ | ○ | Δ |
| Ex. 9 | 1500 | 92 | 2 | 7 | 90 | 10 | X | Δ | ○ | ○ |
| Comp. Ex. 8 | 1500 | 92 | 2 | 7 | 135 | 10 | X | X | ○ | ○ |
| Ex. 10 | 1500 | 92 | 2 | 5 | 45 | 10 | ○ | ○ | X | ○ |
| Ex. 11 | 1500 | 92 | 2 | 5 | 55 | 10 | ○ | ○ | Δ | ○ |
| Ex. 12 | 1500 | 92 | 2 | 5 | 90 | 10 | ○ | ○ | ○ | ○ |
| Ex. 13 | 1500 | 92 | 2 | 5 | 135 | 10 | X | Δ | ○ | ○ |
| Comp. Ex. 9 | 1500 | 92 | 2 | 5 | 145 | 10 | X | X | ○ | ○ |
| Ex. 14 | 1500 | 92 | 2 | 2 | 55 | 10 | ○ | ○ | Δ | ○ |
| Ex. 15 | 1500 | 92 | 2 | 2 | 90 | 10 | ○ | ○ | ○ | ○ |
| Ex. 16 | 1500 | 92 | 2 | 2 | 135 | 10 | X | ○ | ○ | ○ |
| Comp. Ex. 10 | 1500 | 92 | 2 | 0.5 | 45 | 10 | — | — | X | X |
| Ex. 17 | 1500 | 92 | 2 | 0.5 | 55 | 10 | ○ | ○ | Δ | Δ |
| Ex. 18 | 1500 | 92 | 2 | 0.5 | 90 | 10 | ○ | ○ | ○ | Δ |
| Ex. 19 | 1500 | 92 | 2 | 0.5 | 105 | 10 | Δ | ○ | ○ | Δ |
| Ex. 20 | 1500 | 92 | 2 | 0.5 | 135 | 10 | X | ○ | ○ | Δ |
| Ex. 21 | 1500 | 92 | 2 | 0.5 | 145 | 10 | X | Δ | ○ | Δ |
| Comp. Ex. 11 | 1500 | 92 | 2 | 0.3 | 55 | 10 | — | — | X | X |
| Comp. Ex. 12 | 1500 | 92 | 2 | 0.3 | 90 | 10 | — | — | X | X |
| Ex. 22 | 1500 | 92 | 2 | 0.3 | 135 | 10 | X | ○ | Δ | X |
| Ex. 23 | 1500 | 92 | 1 | 7 | 90 | 10 | Δ | Δ | ○ | ○ |
| Ex. 24 | 1500 | 92 | 1 | 7 | 135 | 10 | X | Δ | ○ | ○ |
| Comp. Ex. 13 | 1500 | 92 | 1 | 5 | 55 | 10 | ○ | ○ | X | Δ |
| Ex. 25 | 1500 | 92 | 1 | 5 | 90 | 10 | ○ | ○ | Δ | ○ |
| Ex. 26 | 1500 | 92 | 1 | 5 | 135 | 10 | Δ | ○ | ○ | ○ |
| Comp. Ex. 14 | 1500 | 92 | 1 | 0.5 | 55 | 10 | ○ | ○ | X | X |
| Comp. Ex. 15 | 1500 | 92 | 1 | 0.5 | 90 | 10 | ○ | ○ | X | Δ |
| Ex. 27 | 1500 | 92 | 1 | 0.5 | 135 | 10 | ○ | ○ | Δ | Δ |

In Table 2, focusing attention on the parameter A, it is confirmed that, in the case where the parameter A is equal to or less than 100 mm, the curl amount of the image receiving paper having a roll core diameter from 30 mm to 50 mm is evaluated as Δ or ○, and the curl of the image receiving paper can be straightened. Further, for example, by comparison between the comparative example 1 and the example 6 in which the parameter A takes different values of 100 mm and 92 mm, respectively, and other conditions are the same, the wrinkle is evaluated as × in the comparative example 1, but ○ in the example 6, and thereby it can be confirmed that the parameter A equal to or less than 92 mm is more suitable.

Focusing attention on the parameter a, it is confirmed that, in the case where the parameter a is from 1 to 7 mm, the curl amount of the image receiving paper having a roll core diameter equal to or more than 30 mm and equal to or more than 50 mm is evaluated as Δ or ○, and the curl of the image receiving paper can be straightened. Further, for example, by comparison between the comparative example 7 and the example 8 in which the parameter a takes different values of 7 mm and 5 mm, respectively, and other conditions are the same, the curl amount in the roll diameter of 50 mm is evaluated as × in the comparative example 7, but Δ in the example 8, and thereby it can be confirmed that the parameter a equal to or less than 5 mm is more suitable. Furthermore, for example, by comparison between the example 11 and the comparative example 13 in which the parameter a takes different values of 2 mm and 1 mm, respectively, and other conditions are the same, the wrinkle is evaluated as Δ in the example 11, but × in the comparative example 13, and thereby it can be confirmed that the parameter a equal to or more than 2 mm is more suitable.

Focusing attention on the parameter b, it is confirmed that, in the case where the parameter b is from 0.3 to 7 mm, the curl amount of the image receiving paper having a roll core diameter equal to or more than 30 mm and equal to or more than 50 mm is evaluated as Δ or ○, and the curl of the image receiving paper can be straightened. Further, for example, by comparison between the comparative example 8 and the example 13 in which the parameter b takes different values of 7 mm and 5 mm, respectively, and other conditions are the same, the curl amount in the roll diameter of 50 mm is evaluated as × in the comparative example 8, but Δ in the example 13, and thereby it can be confirmed that the parameter b equal to or less than 5 mm is more suitable. Furthermore, for example, by comparison between the example 18 and the comparative example 12 in which the parameter b takes different values of 0.5 mm and 0.3 mm, respectively, and other conditions are the same, the jam is evaluated as Δ in the example 18, but × in the comparative example 12, and thereby it can be confirmed that the parameter b equal to or more than 0.5 mm is more suitable.

Focusing attention on the parameter C, it is confirmed that, in the case where the parameter C is from 45 to 145 degrees, the curl amount of the image receiving paper having a roll core diameter equal to or more than 30 mm and equal to or more than 50 mm is evaluated as Δ or ○, and the curl of the image receiving paper can be straightened. Further, for example, by comparison between the comparative example 10 and the example 11 in which the parameter C takes different values of 45 degrees and 55 degrees, respectively, and other conditions are the same, the wrinkle is evaluated as × in the comparative example 10, but Δ in the example 11, and thereby it can be confirmed that the parameter C equal to or more than 55 degrees is more suitable. Furthermore, for example, by comparison between the example 13 and the comparative example 9 in which the parameter C takes different values of 135 degrees and 145 degrees, respectively, and other conditions are the same, the curl amount in the-roll core diameter of 50 mm is evaluated as Δ in the example 13, but × in the comparative example 9, and thereby it can be confirmed that the parameter C equal to or less than 135 degrees is more suitable.

Table 3 shows examples and comparative examples in the case where the stiffness of the image receiving paper is fixed to 1,500 mg, the parameters a, b, and B are fixed to 2 mm, 2 mm, and 10 mm, respectively, and the parameters A and Care varied.

TABLE 3

| | stiffness | A | a | b | C | B | curl amount | | | |
|---|---|---|---|---|---|---|---|---|---|---|
| | (mg) | (mm) | (mm) | (mm) | (degree) | (mm) | 30 mm | 50 mm | wrinkle | jam |
| Ex. 14 | 1500 | 92 | 2 | 2 | 55 | 10 | ○ | ○ | Δ | ○ |
| Ex. 15 | 1500 | 92 | 2 | 2 | 90 | 10 | ○ | ○ | ○ | ○ |
| Ex. 16 | 1500 | 92 | 2 | 2 | 135 | 10 | X | ○ | ○ | ○ |
| Ex. 28 | 1500 | 30 | 2 | 2 | 55 | 10 | ○ | ○ | Δ | ○ |
| Ex. 29 | 1500 | 30 | 2 | 2 | 90 | 10 | Δ | ○ | ○ | ○ |
| Ex. 30 | 1500 | 30 | 2 | 2 | 135 | 10 | X | Δ | ○ | ○ |
| Ex. 31 | 1500 | 10 | 2 | 2 | 55 | 10 | Δ | ○ | ○ | ○ |
| Ex. 32 | 1500 | 10 | 2 | 2 | 90 | 10 | X | Δ | ○ | ○ |
| Ex. 33 | 1500 | 10 | 2 | 2 | 135 | 10 | X | Δ | ○ | ○ |
| Comp. Ex. 16 | 1500 | 7 | 2 | 2 | 45 | 10 | — | — | Δ | X |
| Comp. Ex. 17 | 1500 | 7 | 2 | 2 | 55 | 10 | X | X | ○ | ○ |
| Comp. Ex. 18 | 1500 | 7 | 2 | 2 | 90 | 10 | X | X | ○ | ○ |

From this table, it is confirmed that, in the case where the parameter A is equal to or more than 10 mm, the curl amount of the image receiving paper having a roll core diameter equal to or more than 30 mm and equal to or more than 50 mm is evaluated as Δ or ○, and the curl of the image receiving paper can be straightened.

Table 4 shows examples and comparative examples in the case where the stiffness of the image receiving paper is fixed to 1,500 mg, the parameters A and B are fixed to 10 mm and 10 mm, respectively, and the parameters a, b, and C are varied.

TABLE 4

| | stiffness | A | a | b | C | B | curl amount | | | |
|---|---|---|---|---|---|---|---|---|---|---|
| | (mg) | (mm) | (mm) | (mm) | (degree) | (mm) | 30 mm | 50 mm | wrinkle | jam |
| Ex. 34 | 1500 | 10 | 5 | 5 | 45 | 10 | Δ | Δ | Δ | Δ |
| Ex. 35 | 1500 | 10 | 5 | 5 | 55 | 10 | Δ | Δ | ○ | ○ |
| Ex. 36 | 1500 | 10 | 5 | 5 | 90 | 10 | X | Δ | ○ | ○ |
| Ex. 37 | 1500 | 10 | 5 | 5 | 135 | 10 | X | Δ | ○ | ○ |
| Comp. Ex. 19 | 1500 | 10 | 5 | 5 | 145 | 10 | X | X | ○ | ○ |
| Comp. Ex. 20 | 1500 | 10 | 2 | 7 | 45 | 10 | — | — | Δ | X |
| Ex. 38 | 1500 | 10 | 2 | 7 | 55 | 10 | X | Δ | ○ | ○ |
| Comp. Ex. 21 | 1500 | 10 | 2 | 7 | 90 | 10 | X | X | ○ | ○ |
| Ex. 39 | 1500 | 10 | 2 | 5 | 55 | 10 | Δ | ○ | ○ | ○ |
| Ex. 40 | 1500 | 10 | 2 | 5 | 90 | 10 | X | Δ | ○ | ○ |
| Ex. 41 | 1500 | 10 | 2 | 5 | 135 | 10 | X | Δ | ○ | ○ |
| Comp. Ex. 22 | 1500 | 10 | 2 | 5 | 145 | 10 | X | X | ○ | ○ |
| Ex. 31 | 1500 | 10 | 2 | 2 | 55 | 10 | Δ | ○ | ○ | ○ |
| Ex. 32 | 1500 | 10 | 2 | 2 | 90 | 10 | X | Δ | ○ | ○ |
| Ex. 33 | 1500 | 10 | 2 | 2 | 135 | 10 | X | Δ | ○ | ○ |
| Comp. Ex. 23 | 1500 | 10 | 2 | 0.5 | 45 | 10 | — | — | Δ | X |
| Ex. 42 | 1500 | 10 | 2 | 0.5 | 55 | 10 | Δ | ○ | ○ | Δ |
| Ex. 43 | 1500 | 10 | 2 | 0.5 | 90 | 10 | X | ○ | ○ | Δ |
| Ex. 44 | 1500 | 10 | 2 | 0.5 | 135 | 10 | X | Δ | ○ | Δ |
| Comp. Ex. 24 | 1500 | 10 | 2 | 0.3 | 90 | 10 | — | — | X | X |
| Ex. 45 | 1500 | 10 | 2 | 0.3 | 135 | 10 | X | Δ | Δ | Δ |
| Ex. 46 | 1500 | 10 | 1 | 5 | 55 | 10 | Δ | ○ | ○ | ○ |
| Ex. 47 | 1500 | 10 | 1 | 5 | 90 | 10 | Δ | ○ | ○ | ○ |
| Ex. 48 | 1500 | 10 | 1 | 5 | 135 | 10 | X | Δ | ○ | ○ |
| Comp. Ex. 25 | 1500 | 10 | 1 | 0.5 | 55 | 10 | ○ | ○ | X | X |
| Ex. 49 | 1500 | 10 | 1 | 0.5 | 90 | 10 | Δ | ○ | X | Δ |
| Ex. 50 | 1500 | 10 | 1 | 0.5 | 135 | 10 | X | Δ | ○ | ○ |
| Comp. Ex. 26 | 1500 | 10 | 1 | 0.5 | 145 | 10 | X | X | ○ | ○ |

Table 4 is common to Table 2 in the point where the stiffness of the image receiving paper is fixed to 1,500 mg, the parameter B is fixed to 10 mm, respectively, and the parameters a, b, and Care varied. On the other hand, Table 2 and Table 4 are different in the point where, in Table 2, the parameter A is set to 100 μm or 92 mm that is a relatively large value, while, in Table 4, the parameter A is set to 10 mm that is a relatively small value. From this Table, it is confirmed that findings similar to those from Table 2 can be obtained about the parameters a, b, and C as well as in the case where the parameter A is 10 mm.

Table 5 shows examples and comparative examples in the case where the parameters A, a, b, and B are fixed to 92 mm, 2 mm, 0.5 mm, and 10 mm, respectively, and the stiffness of the image receiving paper and the parameter C are varied.

In addition, Table 6 shows examples and comparative examples in the case where the parameters A, a, b, and B are fixed to 10 mm, 5 mm, 5 mm, and 10 mm, respectively, and the stiffness of the image receiving paper and the parameter C are varied.

The combination of the parameters A, a, b, and B in Table 5 provides higher probability of occurrence of a jam than the combinations in other examples. The combination of the parameters A, a, b, and B in Table 6 provides higher probability that the curl can not be sufficiently straightened than the combinations in other examples.

TABLE 5

| | stiffness | A | a | b | C | B | curl amount | | | |
|---|---|---|---|---|---|---|---|---|---|---|
| | (mg) | (mm) | (mm) | (mm) | (degree) | (mm) | 30 mm | 50 mm | wrinkle | jam |
| Comp. Ex. 27 | 3000 | 92 | 2 | 0.5 | 55 | 10 | Δ | ○ | X | X |
| Comp. Ex. 28 | 3000 | 92 | 2 | 0.5 | 90 | 10 | X | Δ | X | X |
| Comp. Ex. 29 | 3000 | 92 | 2 | 0.5 | 135 | 10 | X | X | Δ | Δ |
| Ex. 51 | 2500 | 92 | 2 | 0.5 | 55 | 10 | ○ | ○ | Δ | Δ |
| Ex. 52 | 2500 | 92 | 2 | 0.5 | 90 | 10 | Δ | ○ | ○ | Δ |
| Ex. 53 | 2500 | 92 | 2 | 0.5 | 135 | 10 | X | Δ | ○ | Δ |
| Comp. Ex. 10 | 1500 | 92 | 2 | 0.5 | 45 | 10 | — | — | X | X |
| Ex. 17 | 1500 | 92 | 2 | 0.5 | 55 | 10 | ○ | ○ | Δ | Δ |
| Ex. 18 | 1500 | 92 | 2 | 0.5 | 90 | 10 | ○ | ○ | ○ | Δ |
| Ex. 19 | 1500 | 92 | 2 | 0.5 | 105 | 10 | Δ | ○ | ○ | Δ |
| Ex. 20 | 1500 | 92 | 2 | 0.5 | 135 | 10 | X | ○ | ○ | Δ |
| Ex. 21 | 1500 | 92 | 2 | 0.5 | 145 | 10 | X | Δ | ○ | Δ |
| Ex. 54 | 500 | 92 | 2 | 0.5 | 55 | 10 | ○ | ○ | ○ | Δ |
| Ex. 55 | 500 | 92 | 2 | 0.5 | 90 | 10 | ○ | ○ | ○ | ○ |
| Ex. 56 | 500 | 92 | 2 | 0.5 | 135 | 10 | Δ | ○ | ○ | ○ |
| Ex. 57 | 500 | 92 | 2 | 0.5 | 145 | 10 | X | ○ | ○ | ○ |
| Comp. Ex. 31 | 65 | 92 | 2 | 0.5 | 55 | 10 | — | — | ○ | X |
| Comp. Ex. 32 | 65 | 92 | 2 | 0.5 | 90 | 10 | — | — | ○ | X |
| Comp. Ex. 33 | 65 | 92 | 2 | 0.5 | 135 | 10 | — | — | ○ | X |
| Comp. Ex. 34 | 65 | 92 | 2 | 0.5 | 145 | 10 | X | X | ○ | Δ |

TABLE 6

| | stiffness | A | a | b | C | B | curl amount | | | |
|---|---|---|---|---|---|---|---|---|---|---|
| | (mg) | (mm) | (mm) | (mm) | (degree) | (mm) | 30 mm | 50 mm | wrinkle | jam |
| Comp. Ex. 30 | 3000 | 10 | 5 | 5 | 55 | 10 | X | X | X | Δ |
| Ex. 58 | 2500 | 10 | 5 | 5 | 55 | 10 | X | Δ | ○ | ○ |
| Ex. 59 | 2500 | 10 | 5 | 5 | 90 | 10 | X | Δ | ○ | ○ |
| Ex. 34 | 1500 | 10 | 5 | 5 | 45 | 10 | Δ | Δ | Δ | Δ |
| Ex. 35 | 1500 | 10 | 5 | 5 | 55 | 10 | Δ | Δ | ○ | ○ |
| Ex. 36 | 1500 | 10 | 5 | 5 | 90 | 10 | X | Δ | ○ | ○ |
| Ex. 37 | 1500 | 10 | 5 | 5 | 135 | 10 | X | Δ | ○ | ○ |
| Comp. Ex. 19 | 1500 | 10 | 5 | 5 | 145 | 10 | X | X | ○ | ○ |
| Ex. 60 | 500 | 10 | 5 | 5 | 55 | 10 | ○ | ○ | ○ | ○ |
| Ex. 61 | 500 | 10 | 5 | 5 | 90 | 10 | ○ | ○ | ○ | ○ |
| Ex. 62 | 500 | 10 | 5 | 5 | 135 | 10 | X | ○ | ○ | ○ |

From these tables, it is confirmed that, even in the case of the combination of the parameters A, a, b, and B that provides higher probability of occurrence of a wrinkle, jam, or the like., the curl of the image receiving paper having stiffness from 500 to 2,500 mg can be straightened.

Table 7 shows examples and comparative examples in the case where the stiffness of the image receiving paper is fixed to 1,500 mg and the parameters a and b are fixed to 2 mm and 2 mm, respectively, and the parameters A, C, and B are varied.

TABLE 7

| | stiffness | A | a | b | C | B | curl amount | | | |
|---|---|---|---|---|---|---|---|---|---|---|
| | (mg) | (mm) | (mm) | (mm) | (degree) | (mm) | 30 mm | 50 mm | wrinkle | jam |
| Comp. Ex. 35 | 1500 | 92 | 2 | 2 | 90 | 0 | — | — | — | X |
| Comp. Ex. 36 | 1500 | 92 | 2 | 2 | 135 | 0 | X | X | ○ | ○ |
| Ex. 63 | 1500 | 92 | 2 | 2 | 135 | 5 | X | ○ | ○ | ○ |
| Ex. 16 | 1500 | 92 | 2 | 2 | 135 | 10 | X | ○ | ○ | ○ |
| Ex. 64 | 1500 | 92 | 2 | 2 | 90 | 5 | ○ | ○ | ○ | ○ |
| Ex. 15 | 1500 | 92 | 2 | 2 | 90 | 10 | ○ | ○ | ○ | ○ |
| Ex. 65 | 1500 | 92 | 2 | 2 | 90 | 100 | ○ | ○ | ○ | ○ |
| Comp. Ex. 37 | 1500 | 10 | 2 | 2 | 90 | 0 | — | — | — | X |
| Ex. 66 | 1500 | 10 | 2 | 2 | 90 | 5 | X | Δ | ○ | ○ |
| Ex. 32 | 1500 | 10 | 2 | 2 | 90 | 10 | X | Δ | ○ | ○ |
| Ex. 67 | 1500 | 10 | 2 | 2 | 90 | 100 | X | Δ | ○ | ○ |

From this table, it is confirmed that, in the case where the parameter B is from 5 to 100 mm, the curl can be straightened.

What is claimed is:

1. A curl straightening method for straightening curl of image receiving paper for sublimation dye transfer by allowing the image receiving paper to pass through gaps of a guide, the method comprising:

providing the guide with a first guide unit and a second guide unit that form the gaps by two planes parallel to each other; and providing the second guide unit on an upstream side of the first guide unit in a feeding direction of the image receiving paper;

disposing the first guide unit and the second guide unit so that the image receiving paper is fed into the second guide unit with the image receiving paper bent opposite to a direction of curling of the image receiving paper, and so that a change in the feeding direction of the image receiving paper from the second guide unit to the first guide unit may be opposite to a direction of curling of the image receiving paper; and allowing the image receiving paper to pass through the guide to straighten the curl of the image receiving paper.

2. A curl straightening method for straightening curl of image receiving paper for sublimation dye transfer by allowing the image receiving paper to pass through gaps of a guide, the method comprising:

providing the guide with a first guide unit and a second guide unit that form the gaps by two planes parallel to each other; and providing the second guide unit on an upstream side of the first guide unit in a feeding direction of the image receiving paper;

disposing the first guide unit and the second guide unit so that the image receiving paper is fed into the second guide unit with the image receiving paper bent opposite to a direction of curling of the image receiving paper, and so that a change in the feeding direction of the image receiving paper from the second guide unit to the first guide unit may be opposite to a direction of curling of the image receiving paper; and allowing the image receiving paper to pass through the guide to straighten the curl of the image receiving paper;

wherein the image receiving paper has stiffness from 500 to 2,500 mg in a direction parallel to a printing direction, which is measured according to JIS L1085 or JIS L1096, and a length of the first guide unit is from 10 mm to 100 mm.

3. The curl straightening method according to claim 2, wherein the length of the first guide unit is from 10 mm to 92 mm.

4. The curl straightening method according to claim 2, wherein the gap of the first guide unit is from 1 mm to 7 mm.

5. The curl straightening method according to claim 4, wherein the gap of the first guide unit is from 2 mm to 5 mm.

6. The curl straightening method according to claim 2, wherein the gap of the second guide unit is from 0.3 mm to 7 mm.

7. The curl straightening method according to claim 6, wherein the gap of the second guide unit is from 0.5 mm to 5 mm.

8. The curl straightening method according to claim 2, wherein an angle formed by the first guide unit and the second guide unit is from 45 degrees to 145 degrees.

9. The curl straightening method according to claim 8, wherein the angle formed by the first guide unit and the second guide unit is from 55 degrees to 135 degrees.

10. The curl straightening method according to claim 2, wherein a length of the curl guide unit is equal to or more than 5 mm.

11. The curl straightening method according to claim 10, wherein the length of the second guide unit is from 5 mm to 100 mm.

12. A curl straightening device, wherein the device straightens curl of image receiving paper for sublimation dye transfer by allowing the image receiving paper to pass through gaps of a guide, a first guide unit and a second guide unit that form the gaps by two planes parallel to each other are provided in the guide, the second guide unit is provided on an upstream side of the first guide unit in a feeding direction of the image receiving paper, and the first guide unit and the second guide unit are disposed so that the image receiving paper is fed into a second guide unit with the image receiving paper being bent opposite to a direction of curling of the image receiving paper, and so that a change in the feeding direction of the image receiving paper from the second guide unit to the first guide unit may be opposite to a direction of curling of the image receiving paper.

* * * * *